United States Patent [19]

Tominaga et al.

[11] Patent Number: 4,844,147

[45] Date of Patent: Jul. 4, 1989

[54] DIP FORMING APPARATUS FOR CONTINUOUSLY FORMING CAST ROD

[75] Inventors: Haruo Tominaga, Sakura; Teruyuki Takayama, Chiba; Kenichi Miyauchi, Funabashi; Tetsuo Yamaguchi, Tokyo, all of Japan

[73] Assignee: Fujikura Ltd., Tokyo, Japan

[21] Appl. No.: 157,119

[22] Filed: Feb. 10, 1988

Related U.S. Application Data

[63] Continuation of Ser. No. 924,650, Oct. 19, 1986, abandoned.

[30] Foreign Application Priority Data

Nov. 12, 1985 [JP] Japan ..... 60-253185

[51] Int. Cl.[4] ..... B22D 11/16

[52] U.S. Cl. ..... 164/450; 164/418; 164/461

[58] Field of Search ..... 164/418, 461, 155, 449, 164/450, 452

[56] References Cited

U.S. PATENT DOCUMENTS 3,685,570 8/1972 Fredrikson et al. ..... 164/461

FOREIGN PATENT DOCUMENTS 57-68263 4/1982 Japan ..... 164/461

*Primary Examiner*—Richard K. Seidel

*Attorney, Agent, or Firm*—Sprung Horn Kramer & Woods

[57] ABSTRACT

A dip forming apparatus for continuously forming a cast rod includes a furnace for holding molten metal, and a crucible having an open top and a bottom wall. The crucible has a core wire-passing region vertically extending therethrough. The crucible has a hole formed through the bottom wall. A passage connects the furnaces to the core wire-passing region. A device is provided for keeping the molten metal in the furnace at a predetermined level so as to flow the molten metal from the furnace to the core wire-passing region through the passage. A partition wall is disposed in the passage and has a throttling orifice of a predetermined size formed therethrough so as to allow the molten metal to pass therethrough to limit the flow of the molten metal from the furnace to the core wire-passing region. A drive device moves the core wire upwardly at a preselected speed through the hole and the core wire-passing region, so that the molten metal in the core wire-passing region accretes on the core wire to form the cast rod.

6 Claims, 4 Drawing Sheets

DIP FORMING APPARATUS FOR CONTINUOUSLY FORMING CAST ROD

This application is a continuation of application Ser. No. 924,650, filed Oct 19, 1986, now abandoned.

BACKGROUND OF THE INVENTION

1. Field of the Invention

This invention relates to a dip forming apparatus for accreting molten metal on a moving core wire to form a cast rod and particularly to such an apparatus best suited for forming a cast rod composed of a core wire of one metal and a thin clad of another metal formed around the core wire.

2. Prior Art

A conventional dip forming apparatus 10 shown in FIG. 1 comprises a furnace 12 for holding molten metal M, a crucible 14 of graphite connected to the furnace 12 via a conduit 16, a crucible housing 18 of a refractory material enclosing the crucible 14, an electric heater element 20 wound around the crucible 14, a hermetic housing 22 connected to a bottom of the crucible housing 18, and a cooling housing 24 defining a cooling chamber and connected to the top of the crucible housing 18. A bushing 26 is fitted in a hole 27 formed through a bottom wall of the crucible 14 and is also connected to a bottom wall of the crucible housing 18. A pulley 28 is mounted within the hermetic housing 22, and three pairs of pinch rolls 90 are also mounted within the hermetic housing 22. The furnace 12 has a pressure portion 30 and a supply portion 32 connected together at their lower ends by a connecting portion 34.

A core wire W of metal is adapted to pass through the hermetic housing 22, the bushing 26 and the crucible 14. The pinch rolls 90 serves to straighten the core wire W and to move it upwardly toward the crucible 14. Thus, the core wire W is continuously fed upwardly through a bath of molten metal M in the crucible 14, so that the molten metal accretes on the outer surface of the core wire W to provide a cast rod R, the accreting metal on the core wire W solidifying to form a clad of the cast rod R.

A level sensor 36 is provided for sensing the level of the molten metal in the supply portion 32 of the furnace 12. A conduit 38 connects the pressure portion 30 of the furnace 12 to a source (not shown) of reducing gas under pressure via a pressure regulator of the diaphragm type (not shown). The supply portion 32 of the furnace 12 has a feed port 40 for selectively supplying molten metal to the supply portion 32 from a supply source (not shown). The pressure regulator is controlled in accordance with the sensing signal from the level sensor 36, so that the pressure in the pressure portion 30 of the furnace 12 is controlled by the pressure regulator so as to keep the molten metal in the supply portion 32 at a predetermined level. The level of the molten metal in the pressure portion 30 is lower than that of the molten metal in the supply portion 32. It will be appreciated that the molten metal in the crucible 14 and the molten metal in the supply portion 32 are at the same level. It is important that the molten metal in the supply portion 32 should be maintained at the predetermined level in order to ensure that the clad of the resulting cast rod R has a uniform thickness along the length thereof. As the accreting operation proceeds, the molten metal is consumed, and the pressure in the pressure portion 30 is increased gradually to keep the molten metal in the supply portion 32 at the predetermined level.

Recently, a cast rod composed of a core wire of one metal and a clad of another metal has been produced, using the above conventional dip forming apparatus. For example, a cast rod composed of a steel core wire and a copper clad has been produced, and particularly it has recently been desired to produce such a cast rod having a thin copper clad, that is to say, a low ratio of the copper clad to the cast rod in cross-sectional area. In the production of a cast rod having such a low area ratio, the level or depth of the molten metal in the crucible 14 is usually several tens of millimeters, and it is necessary that a deviation from the predetermined level of the molten metal in the crucible 14 should be maintained within a range of plus or minus several millimeters in order to ensure that a variation in amount of accretion of molten metal around the core wire in its longitudinal direction is kept to a minimum. The reason is that the variation in accretion amount will invite a variation in electrical conductivity and tensile strength of the resultant cast rod.

The reducing gas is introduced into the pressure portion 30 under the control of the pressure regulator of the diaphragm type so as to increase the pressure in the pressure portion 30, and a pressure variation can be kept at best to $\pm 0.01$ kgf/cm$^2$. Therefore, a deviation of the level of the molten metal in the crucible 14 is about $\pm 11$ mm as indicated below:

$$10000 \text{ mm}/8.9 \text{ (specific gravity of copper)} \times 0.01 = 11 \text{ mm}$$

Thus, with the conventional dip forming apparatus, it has been rather difficult to produce a cast rod having a relatively low cross-sectional area ratio of the copper clad to the cast rod and having substantially constant electrical conductivity and tensile strength. Incidentally, in the production of a cast rod of the type in which the ratio of the copper clad to the cast rod in cross-sectional area is relatively high, for example, 60 to 70%, the level or depth of the molten metal in the crucible is usually several hundreds of millimeters, and a deviation of this level resulting from a change in the pressure of the pressure portion 30 is relatively small with respect to the molten metal level in the crucible. Therefore, in such a case, the level variation in the crucible has not adversely affected the ratio of the clad to the cast rod.

For a better understanding of the conventional dip forming apparatus, FIG. 2 shows a relation between a time of dipping of the core wire in the crucible and a ratio of the accreted metal on the core wire to the cast rod (i.e., the cross-sectional area ratio of the copper clad to the cast rod). If a low area ratio of 20 to 30% is desired, the dipping time need to be not more than one tenths of the dipping time required for the conventional cast rod having an area ratio of 60 to 70%, and therefore the depth of the molten metal in the crucible need to be not more than one tenths. A distribution of the area ratio of the cast rod in its longitudinal direction is shown in a broken line in FIG. 3. As is clear from FIG. 3, a variation in the area ratio is relatively large. The reason why the area ratio is subjected to such a large variation is that a deviation of the level of the molten metal in the crucible is relatively large with respect to this level.

SUMMARY OF THE INVENTION

It is therefore an object of this invention to provide a dip forming apparatus of the type which can produce a cast rod having a relatively low cross-sectional area ratio of a clad to the cast rod and having a substantially constant electrical conductivity and tensile strength.

According to the present invention, there is provided a dip forming apparatus for continuously forming a cast rod comprising:

(a) a furnace for holding molten metal;

(b) a crucible having an open top and a bottom wall, said crucible having a core wire-passing region extending from said bottom wall to said open top, said crucible having a hole formed through said bottom wall, said hole being disposed in vertical registry with said core wire-passing region;

(c) passage means connecting said furnace to said core wire-passing region of said crucible for supplying the molten metal to said region;

(d) means for keeping the molten metal in said furnace at a predetermined level so as to flow the molten metal from said furnace to said core wire-passing region through said passage means;

(e) a partition wall member disposed in said passage means and having a throttling orifice of a predetermined size formed therethrough so as to allow the molten metal to pass therethrough to limit the flow of the molten metal from said furnace to said core wire-passing region; and (f) drive means for moving a core wire upwardly at a preselected speed through said hole and said core wire-passing region of said crucible, so that the molten metal in said core wire-passing region accretes on the core wire to form the cast rod.

DESCRIPTION OF THE PREFERRED EMBODIMENTS OF THE INVENTION

Figure 1:
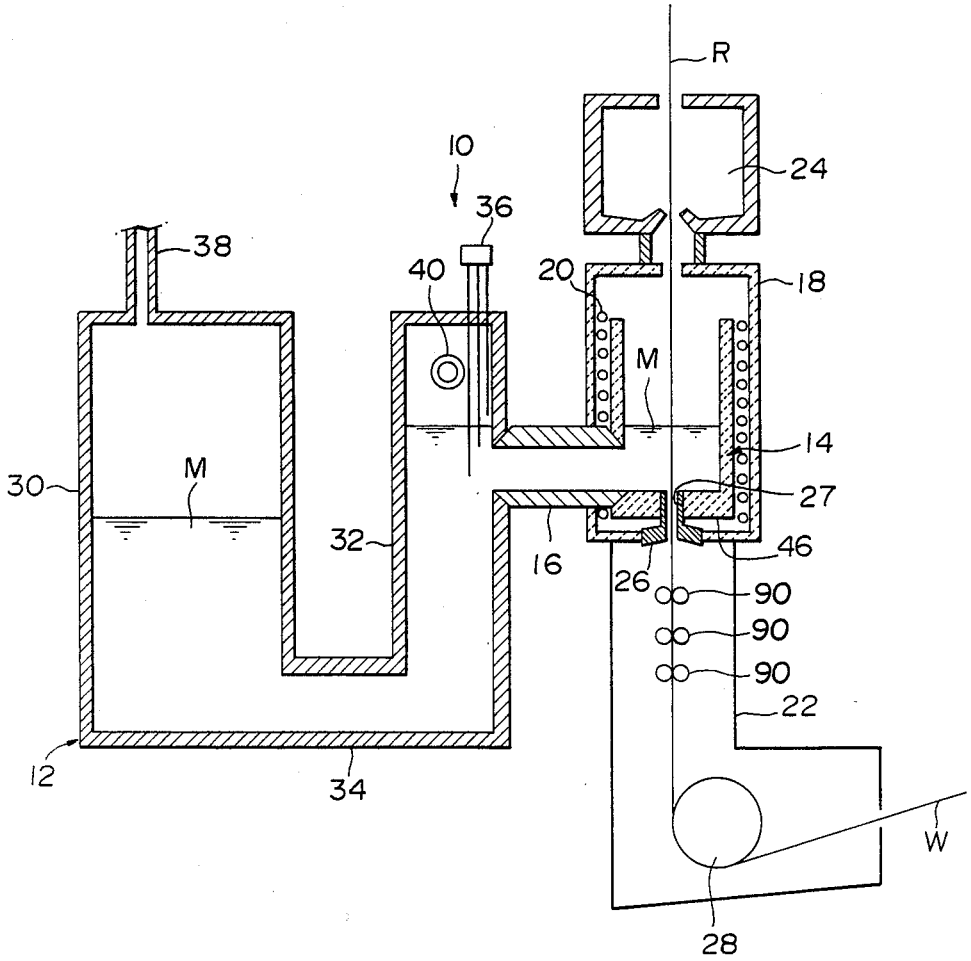
FIG. 1 (Prior Art)
FIG. 1 is a cross-sectional view of a dip forming apparatus provided in accordance with the prior art.
Figure 2:
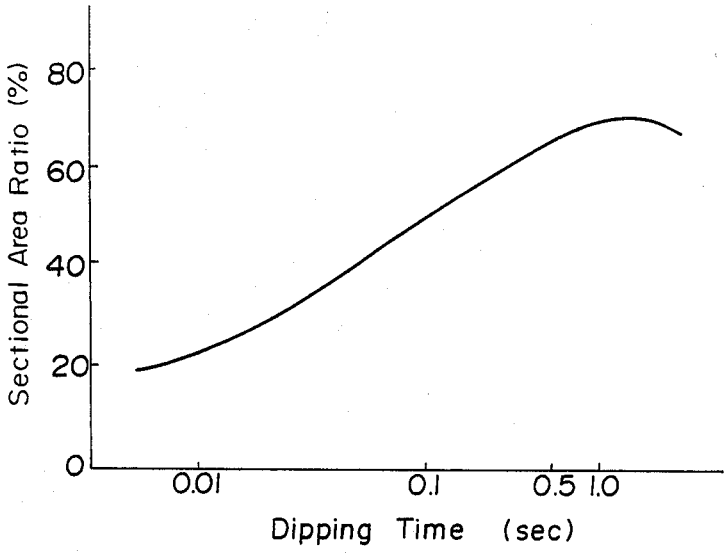
FIG. 2 is a graph showing a relation between a time of dipping of a core wire in a crucible and a cross-sectional area ratio of accreted metal on the core wire to the cast rod.

The invention will now be described with reference to the drawings in which like reference numerals denote corresponding parts in several views.

Figure 4:
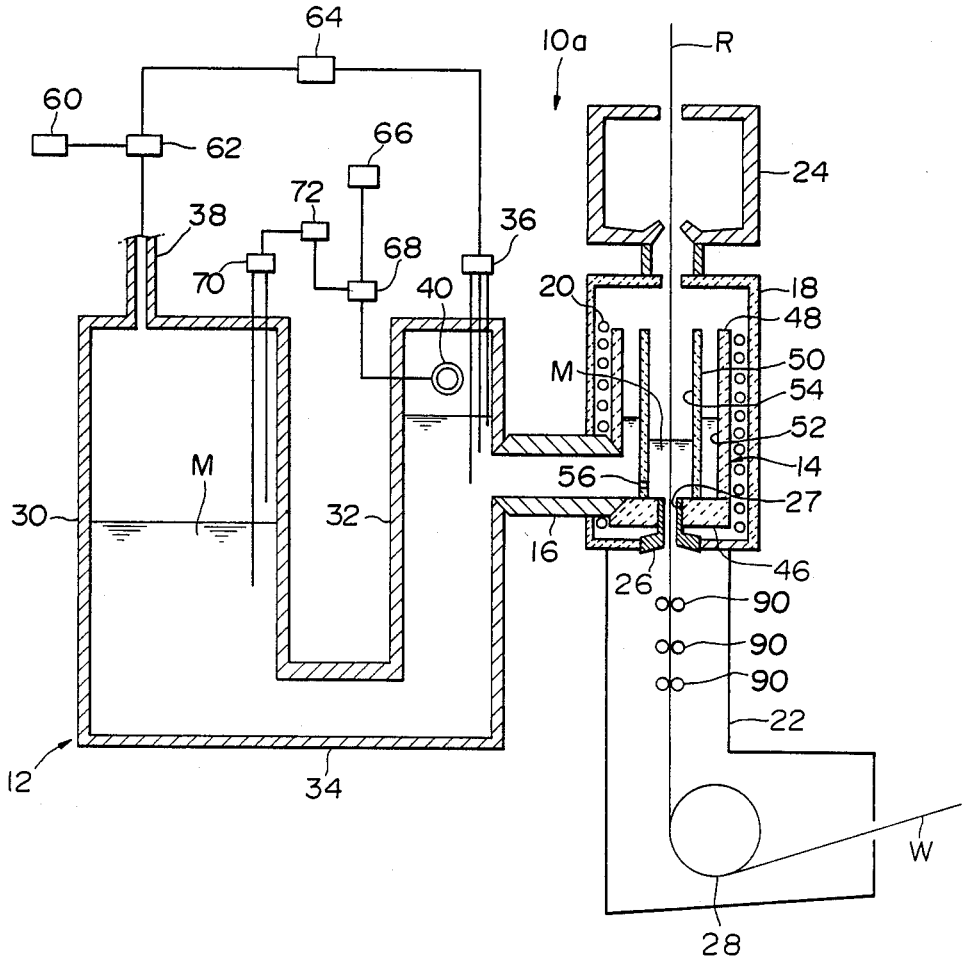
FIG. 4 is a view generally similar to FIG. 1 but showing a dip forming apparatus provided in accordance with the present invention.

A dip forming apparatus 10*a* shown in FIG. 4 comprises a furnace 12 for holding molten metal M, a crucible 14 of graphite having an open top and connected to the furnace 12 via a conduit 16, a crucible housing 18 of a refractory material enclosing the crucible 14, an electric heater element 20 wound around the crucible 14, a hermetic housing 22 connected to a bottom of the crucible housing 18, and a cooling housing 24 defining a cooling chamber and connected to the top of the crucible housing 18. A bushing 26 is fitted in a hole 27 formed through a bottom wall 46 of the crucible 14 and is also connected to a bottom wall of the crucible housing 18. A pulley 28 is mounted within the hermetic housing 22, and three pairs of pinch rolls 90 are also mounted within the hermetic housing 22. A core wire W is engaged with the pulley 28 and the pinch rolls 90, and the lowermost pinch rolls 30 are connected to a motor (not shown) for being driven for rotation to move the core wire W upwardly at a preselected speed. The furnace 12 has a vertically-disposed pressure portion or chamber 30 and a vertically-disposed supply portion or chamber 32 connected together at their lower ends by a connecting portion 34.

The crucible 14 comprises an outer peripheral wall 48 of a cylindrical shape disposed vertically, the bottom wall 46 of a circular shape closing a lower end of the cylindrical wall 48, and a tubular partition wall 50 disposed coaxially within the outer cylindrical wall 48 in spaced relation thereto and extending upwardly from the bottom wall 46 along an axis thereof so as to form an annular chamber 52 therebetween. The upper ends of the cylindrical wall 48 and tubular partition wall 50 are disposed at the same level, and the diameter of the tubular partition wall 50 is about half the diameter of the outer cylindrical wall 48. The bushing 26 and the tubular partition wall 50 are disposed coaxially with each other, so that a core wire W, introduced into the crucible 14 from the bushing 26, passes through a central chamber 54 defined by the tubular partition wall 50. Thus, the central chamber 54 defines a core wire-passing region.

The horizontally-disposed conduit or spout 16 is connected at one end to the outer cylindrical wall 48. An aperture or throttling orifice 56 of a circular shape is formed through the partition wall 50 adjacent to the bottom wall 46 so as to communicate the annular chamber 52 with the central chamber 54. The throttling orifice 56 offers resistance to the flow of the molten metal and therefore limits the flow of the molten metal from the annular chamber 52 to the central chamber 54.

A conduit 38 connects the pressure portion 30 of the furnace 12 to a source 60 of reducing gas under pressure via a pressure regulator 62 of the diaphragm type, so that reducing gas is supplied to the pressure portion 30 to increase the pressure therein. A level sensor 36 senses the level of the molten metal M in the supply portion 32 of the furnace 12 to output a sensing signal to a first controller 64 of the conventional type which in turn feeds a control signal to the pressure regulator 62 in response to the sensing signal, so that the pressure in the pressure portion 30 is so controlled as to keep the molten metal level in the supply portion 32 to a predetermined level during the accreting operation.

A feed port 40 formed in the supply portion 32 of the furnace 12 is connected to a source 66 of molten metal via a flow control valve 68. A second level sensor 70 senses the level of the molten metal in the pressure portion 30 to output a sensing signal to a second controller 72 of the conventional type which in turn outputs a control signal to the flow control valve 68 when the molten metal level in the pressure portion 30 is reduced to a predetermined level. When the control signal is outputted from the controller 72, the flow control valve 68 is opened to supply a predetermined amount of molten metal to the supply portion 32 through the feed port 40.

In operation, the reducing gas is first introduced into the pressure portion 30 of the furnace 12 to increase a pressure therein to a predetermined level to move the level of the molten metal in the supply portion 32 to a predetermined level, so that the molten metal is fed to the crucible 14. As a result, the molten metal flows from the annular chamber 52 to the central chamber 54 via the throttling orifice 56. Then, the molten metal in the central chamber 54 reaches a predetermined level. In this condition, the core wire W is introduced into the central chamber 54 through the bushing 26 and is upwardly moved by the drive pinch rolls 90 at a preselected speed, so that the molten metal accretes on the moving core wire W to form a cast rod R. The accreted metal on the core wire is cooled and solidified at the cooling housing 24 to form a clad of the cast rod R. As the accreting operation proceeds, the pressure in the pressure portion 30 is gradually increased to ensure that the molten metal in the supply portion 32 is kept at the predetermined level. Thus, the molten metal continuously flowing from the annular chamber 52 into the central chamber 54 through the orifice 56 compensates for the molten metal consumed by the accreting in the central chamber 54.

The diameter of the orifice 56 is so determined that during the accreting operation, the level of the molten metal in the central chamber 54 is lower than the level of the molten metal in the annular chamber 52, thereby ensuring that the molten metal is caused to flow into the central chamber 54 from the annular chamber 52 via the orifice 56 to compensate for the accreted metal. The diameter of the conduit 16 is sufficiently large that the molten metal in the annular chamber 52 is at the same level as the molten metal in the supply portion 32. And, the maximum amount of flow of the molten metal into the central chamber 54 through the orifice 56 is slightly larger than the amount of accretion of the molten metal. Also, the diameter of the orifice 56 is so determined that a change in the molten metal level in the central chamber 54 occurs an appropriate period of time after a change in the molten metal level in the annular chamber 52 occurs.

With this arrangement, even if the level of molten metal in the supply portion 32 and hence the level of molten metal in the annular chamber 52 are varied when the pressure in the pressure portion 30 is changed, such a level variation is not directly transmitted to the molten metal in the central chamber 54 thanks to the provision of the orifice 56. Thus, even in such a case, a variation in the molten metal level in the central chamber 54 is much smaller than that in the molten metal level in the supply portion 32 and annular chamber 52. Therefore, the dip forming apparatus 10*a* can produce the cast rod in which the clad resulting from the accreted metal has a more uniform thickness or cross-sectional area along the length of the cast rod R than the clad of the cast rod produced by the conventional dip forming apparatus 10 of FIG. 1. Therefore, even in the case where the cast rod has a relatively low cross-sectional area ratio of the clad to the cast rod, the strength and electrical conductivity of the cast rod are constant. In addition, the dip forming apparatus 10*a* according to the present invention can be easily provided by adding the partition wall 50 to the conventional dip forming apparatus 10 of FIG. 1. Thus, the conventional apparatus can be modified at low costs. Further, since the orifice 56 is formed through the partition wall 50 of the crucible 14 immediately adjacent to the bottom wall 46, the flow of molten metal into the central chamber 54 through the orifice 56 will not disturb the surface of the molten metal in the central chamber 54.

The invention will now be described by way of the following Example:

EXAMPLE

A cast rod was prepared using the dip forming apparatus 10*a* of FIG. 4. Specifically, the diameter of the orifice 56 formed through the partition wall 50 was 5 mm. A core wire, having a diameter of 7.15 mm and subjected to surface cleaning, was introduced into the central chamber 54 from the bushing 26 and was passed upwardly therethrough at a speed of 70 m/min., so that the molten metal in the central chamber 54 accreted on the moving core wire to form the cast rod. During the accreting operation, the depth of the molten metal in the central chamber 54 was 55±2 mm, and the depth of the molten metal in the annular chamber 52 was 81±11 mm. Thus, the average level difference between the two chambers 52 and 54 was 26 mm. This level difference was caused by the flow resistance offered by the orifice 56. And, a level variation of 11 mm in the annular chamber 52 was attenuated to a level variation of 2 mm in the central chamber 54 by virtue of the provision of the throttling orifice 56. Incidentally, when the molten metal level in the annular chamber 52 was maintained at its higher level for a certain time period T (sec), a deviation D (mm) from the predetermined level (55 mm) in the central chamber 54 is obtained by dividing the product of the extra amount E ($cm^3$/sec) of flow of the molten metal into the central chamber 54 and said certain time period T by the base area B of the central chamber 54 (i.e., $D=ET/B$).

Figure 3:
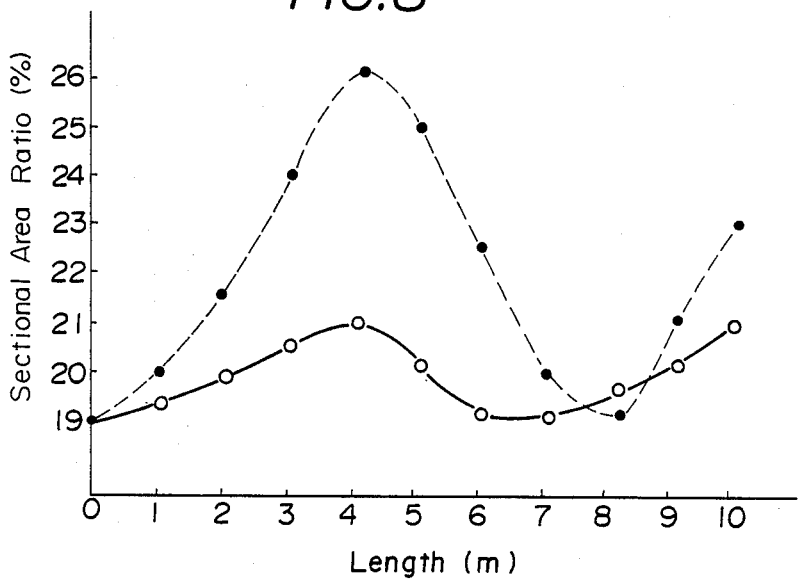
FIG. 3 is a graph showing distributions of the cross-sectional area ratio of cast rods in its longitudinal direction.

A distribution of the cross-sectional area ratio of the so produced cast rod in its longitudinal direction is shown in a solid line in FIG. 3. As is clear from FIG. 3, a variation in the area ratio is about 2% while a variation in the area ratio of the conventional cast rod indicated in the broken line is about 7%.

Figure 5:
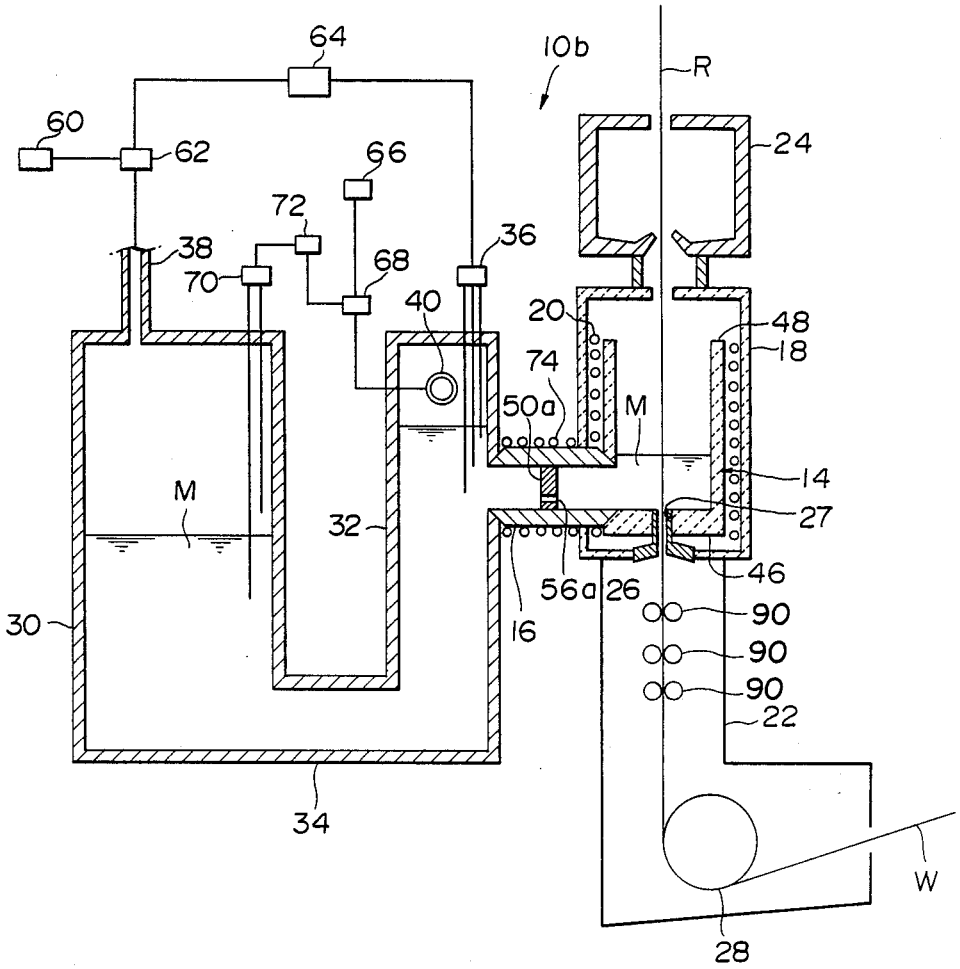
FIG. 5 is a view similar to FIG. 4 but showing a modified dip forming apparatus.

FIG. 5 shows a modified dip forming apparatus 10*b* which differs from the dip forming apparatus 10*a* of FIG. 4 in that instead of the tubular partition wall 50, a partition wall 50*a* in the form of a circular plate is mounted in the conduit 16, the partition wall 50*a* being sealingly secured at its periphery to the inner peripheral surface of the conduit 16. The partition wall 50*a* has a throttling orifice 56*a* formed therethrough which performs the same function as the throttling orifice 56 does. Another modification is that an electrical heating element or wire 74 is wound around the conduit 16 to prevent the molten metal passing through the conduit 16 from solidifying. Incidentally, without the heating element 74, when the molten metal in the crucible 14 is held at a temperature of 1250° C., the temperature of the molten metal in the conduit 16 is 800° C.

What is claimed is:

1. A dip forming apparatus for continuously forming a cast rod comprising:

(a) a furnace for holding molten metal and including a pressure chamber, a supply chamber and passage means to connect the pressure chamber and the supply chamber;

(b) a means for supplying gas under pressure to said pressure chamber, said means controlled by a pressure regulator, (c) a level sensor disposed in said supply chamber, (d) a crucible having an open top and a bottom wall, said crucible having a core wire-passing region extending from said bottom wall to said open top, said crucible having a hole formed through said bottom wall, said hole being disposed in vertical registry with said core wire-passing region;

(e) passage means connecting the supply chamber of said furnace to a lower part of said core wire-passing region of said crucible for supplying the molten metal to said region;

(f) a controller connecting the pressure regulator and the level sensor whereby the pressure regulator is controlled in relation to the level sensor thereby keeping the molten metal in the supply chamber of said furnace at a predetermined level so as to flow the molten metal from said furnace to said core wire-passing region through said passage means;

(g) flow limiting means disposed in said passage means for maintaining the surface of the molten metal in the crucible at a prescribed level below the predetermined level in the supply chamber, said flow limiting means comprising a partition wall member having a throttling orifice of predetermined size; and (h) drive means for moving a core wire upwardly at a preselected speed through said hole and said core wire-passing region of said crucible, so that the molten metal in said core wire-passing region accretes on the core wire to form the cast rod.

2. A dip forming apparatus according to claim 1, in which said passage means comprises a conduit, said partition wall member being in the form of a plate mounted within said conduit and sealingly secured around its periphery to an inner peripheral surface of said conduit.

3. A dip forming apparatus according to claim 2, in which heating means is mounted on said conduit for heating the molten metal passing through said conduit.

4. A dip forming apparatus according to claim 1, wherein a level sensor is disposed in said pressure chamber and said level sensor is connected to a source of molten metal for feeding said molten metal to the supply chamber.

5. A dip forming apparatus for continuously forming a cast rod comprising:

(a) a furnace holding molten metal;

(b) a crucible having an open top and a bottom wall, said crucible having a core wire-passing region extending from said bottom wall to said open top, said crucible having a hole formed through said bottom wall, said hole being disposed in vertical registry with said core wire-passing region, said crucible comprising an outer peripheral wall having a lower end closed by said bottom wall and a partition wall having a tubular shape and being disposed within said outer peripheral wall in spaced relation thereto and extending upwardly from said bottom wall so as to define an annular chamber between said outer peripheral wall and said tubular partition wall, and the interior of said tubular partition wall defining said core wire-passing region;

(c) passing means connecting said furnace to said annular chamber for supplying the molten metal to said annular chamber;

(d) means for keeping the molten metal in said furnace at a predetermined level so as to flow the molten metal from said furnace to said annular chamber through said passage means to maintain the molten metal in the annular chamber at a selected level, said means comprising a means for supplying gas under pressure to a pressure chamber of the furnace, said means for supplying gas controlled by a pressure regulator, a level sensor disposed in a supply chamber of the furnace, a passage means connecting the supply chamber and the pressure chamber, a controller connecting the pressure regulator and the level sensor;

(e) drive means for moving a core wire upwardly at a preselected speed through said hole and said core wire-passing region of said crucible, so that the molten metal in said core wire-passing region accretes on the core wire to form the cast rod; and (f) flow limiting means comprising a throttling orifice formed through the partition wall adjacent said bottom wall of said crucible, said flow limiting means configured to limit the flow of the molten metal form said annular chamber to said core wire-passing region and to keep the surface of the molten metal in the core wire-passing region stable at a prescribed level below said selected level of the molten metal in the annular chamber.

6. A dip forming apparatus according to claim 5, wherein a level sensor is disposed in said pressure chamber and said level sensor is connected to a source of molten metal for feeding said molten metal to the supply chamber.

* * * * *